US005889219A

United States Patent [19]

Moriguchi et al.

[11] Patent Number: 5,889,219

[45] Date of Patent: Mar. 30, 1999

[54] SUPERHARD COMPOSITE MEMBER AND METHOD OF MANUFACTURING THE SAME

[75] Inventors: Hideki Moriguchi; Yoshifumi Arisawa; Michio Otsuka, all of Hyogo, Japan

[73] Assignee: Sumitomo Electric Industries, Ltd., Osaka, Japan

[21] Appl. No.: 745,422

[22] Filed: Nov. 12, 1996

[30] Foreign Application Priority Data

Nov. 16, 1995 [JP] Japan ..... 7-322268
Oct. 4, 1996 [JP] Japan ..... 8-283075

[51] Int. Cl.[6] ..... C22C 29/02; B22F 3/12

[52] U.S. Cl. ..... 75/236; 75/238; 75/242; 51/307; 428/552; 419/13; 419/14; 419/16; 419/18; 419/23; 419/35; 419/48

[58] Field of Search ..... 75/236, 238, 242; 51/307; 428/552; 419/13, 14, 16, 18, 23, 35, 48

[56] References Cited

U.S. PATENT DOCUMENTS

| | | | |
|---|---|---|---|
| 1,904,049 | 4/1933 | Hoyt . | |
| 4,097,274 | 6/1978 | Bakul et al. | 75/201 |
| 4,505,746 | 3/1985 | Nakai et al. | 75/243 |
| 4,828,611 | 5/1989 | Nakai et al. | 75/236 |
| 5,096,465 | 3/1992 | Chen et al. | 51/295 |
| 5,158,148 | 10/1992 | Keshavan | 175/426 |
| 5,169,572 | 12/1992 | Matthews | 264/27 |
| 5,271,749 | 12/1993 | Rai et al. . | |
| 5,585,175 | 12/1996 | Brandrup-Wognsen et al. | 428/323 |

FOREIGN PATENT DOCUMENTS

| | | |
|---|---|---|
| 751434 | 6/1970 | Belgium . |
| 0493351 | 7/1992 | European Pat. Off. . |
| 1482372 | 5/1967 | France . |
| 53-136790 | 11/1978 | Japan . |
| 61-58432 | 12/1986 | Japan . |
| 6-074698 | 3/1994 | Japan . |
| 6-287076 | 10/1994 | Japan . |
| 7-034157 | 2/1995 | Japan . |
| 7-269293 | 10/1995 | Japan . |

*Primary Examiner*—Ngoclan Mai
*Attorney, Agent, or Firm*—W. F. Fasse; W. G. Fasse

[57] ABSTRACT

A sintered body having diamond grains dispersed and held in a matrix of cemented carbide or cermet is obtained by direct resistance heating and pressurized sintering. The sintering is performed at a liquid phase generating temperature in a short time, so that the diamond grains are not directly bonded to each other. Thus, a superhard composite member that has excellent hardness and wear resistance can be obtained without employing an ultra high-pressure vessel.

36 Claims, 3 Drawing Sheets

SUPERHARD COMPOSITE MEMBER AND METHOD OF MANUFACTURING THE SAME

BACKGROUND OF THE INVENTION

1. Field of the Invention

The present invention relates to a superhard composite member consisting of a sintered body of cemented carbide or the like with diamond grains, dispersed therein to form a composite and a method of manufacturing the same.

2. Description of the Background Art

It is well known that a sintered body of WC cemented carbide or the like containing diamond is manufactured using an ultra high-pressure vessel at a pressure of 5.5 GPa and a temperature of 1500° C. under thermodynamically stable conditions (refer to Japanese Patent Laying-Open No. 53-136790 (1978), Japanese Patent Publication No. 61-58432 (1986), U.S. Pat. No. 5,158,148 and the like). However, disadvantageously, the sintered body manufactured by such a technique is expensive and restricted in shape.

Japanese Patent Laying-Open No. 7-34157 (1995) (prior art 1) discloses a technique of sintering the material under thermodynamically instable pressure and temperature conditions for diamond in a solid phase thereby preparing a diamond composite member without employing an ultra high-pressure vessel, as one of the proposals for solving the aforementioned problem.

Japanese Patent Laying-Open No. 6-287076 (1994) (prior art 2) discloses a technique of direct resistance heating and pressurized sintering an inclination functional member having an inclination mixed layer consisting of a metal and ceramics between members of the metal and the ceramics with a molding outer frame and upper and lower push rods. In this case, the molding outer frame serving as one of electrical paths is varied in thickness thereby forming a temperature gradient which is responsive to an inclined composition. The term "inclination mixed layer" indicates a layer having an inclined composition, i.e., a concentration gradient (composition change) of the components.

On the other hand, U.S. Pat. No. 5,096,465 (prior art 3) discloses a technique of preparing a composite member containing metal-coated superhard grains of diamond or CBN in a binder phase by infiltration.

In the prior art 1, however, the material is sintered in a solid phase, and hence bonding strength between the diamond and a metal binder is so insufficient that the diamond may drop out of the binder.

The prior art 2 is not directed to a diamond composite member, dissimilarly to the present invention.

In the infiltration of the prior art 3, the diamond variance depends on the grain sizes of the added diamond, i.e., the packing density of the diamond grains, and hence it is difficult to prepare a composite member having an arbitrary diamond variance with arbitrary diamond grain sizes. Further, it is difficult to prepare a dense composite member by the infiltration, and this disadvantage is particularly remarkable in a large-sized or heteromorphic member.

Thus, there has been a long felt need for a strong diamond composite member having a sufficiently dense and homogeneous structure, which is prepared without employing an ultra high-pressure vessel.

SUMMARY OF THE INVENTION

An object of the present invention is to provide a superhard composite member having a sufficiently dense and homogeneous structure which can be manufactured without employing an ultra high-pressure vessel, and a method of manufacturing the same.

The inventive composite member is adapted to attain the aforementioned object, and contains a hard phase of at least one element selected from a group of WC, TiC, TiN and Ti(C, N), a binder phase consisting of an iron family metal and diamond grains, which are formed by direct resistance heating and pressurized sintering. In other words, the inventive composite member is a sintered body, holding diamond grains in a matrix of cemented carbide or cermet in a dispersed state, which is obtained by direct resistance heating and pressurized sintering. In particular, a member composited with diamond grains, i.e. having diamond grains dispersed therein to form a composite, is preferably prepared from a hard phase of WC cemented carbide, i.e., WC, and a binder phase of Co or Ni. This is because WC cemented carbide has high rigidity and is excellent in strength and toughness. The binder phase is preferably prepared from an iron family metal such as Co, Ni, Cr or Fe. The inventive composite member may contain unavoidable impurities, as a matter of course. Examples of the unavoidable impurities are Al, Ba, Ca, Cu, Fe, Mg, Mn, Ni, Si, Sr, S, O, N, Mo, Sn, Cr and the like.

The direct resistance heating and pressurized sintering can be completed in a short time within 10 minutes since the sintered material can be rapidly heated, pressurized and cooled by resistance heating without employing an external heater. Therefore, the time for exposing the sintered material to a high temperature can be reduced as compared with the case of merely reducing the maximum temperature holding time in conventional pressure sintering, so that the sintering can be ended with no transformation of diamond to graphite. Further, the bonding strength between diamond and the matrix can be increased by the direct resistance heating and pressurized sintering process, although the reason for this has not yet been clarified. In addition, it is also possible to accelerate the sintering by generating plasma between the grains through a pulse current. Thus, a performance merit or advantage specific to the inventive composite member, which has been impossible to attain through the conventional pressure sintering, can be attained by the direct resistance heating and pressurized sintering. Further, the inventive composite member can be manufactured in a short-time cycle, whereby cost reduction can be expected due to improvement in the rate of operation of equipment.

In addition to the aforementioned factors, the inventive composite member preferably comprises the following factors independently of or in combination with each other:

(1) The resistance heating and pressurized sintering is performed under such conditions that diamond is thermodynamically metastable and a liquid phase is present.

In a composite member manufactured by the conventional method employing an ultra high-pressure vessel, the material is sintered in a thermodynamically stable state of diamond at a temperature exceeding the eutectic point of diamond and the binder phase of Co or the like. Thus, it has been said that diamond grains repeat a process of being dissolved in Co of a liquid phase and re-deposited on diamond surfaces during sintering to result in direct bonding (D-D bonding) of the diamond grains and formation of skeletons, thereby improving the strength of the sintered body.

According to the present invention, on the other hand, the material is sintered in a metastable state of diamond, and hence dissolution of diamond grains in the binder phase is suppressed to the utmost so that diamond grains once dissolved in the liquid phase are not re-deposited as diamond. Thus, no direct bonding of diamond grains is caused and improvement in strength of the sintered body is attained by the matrix of cemented carbide or the like. Further, the direct resistance heating and pressurized sintering is completed in a short time, whereby diamond can be inhibited from being transformed to graphite even if the material is sintered in the presence of a liquid phase, and a dense sintered body can be manufactured due to formation of the liquid phase. Therefore, sufficient sintered body strength can be attained due to improvement in bonding strength between diamond and the matrix, in addition to the excellent strength and toughness of the matrix itself.

(2) (001) planes of WC crystals are particularly developed on a certain cross section of the composite member.

When direct resistance heating and pressurized sintering is performed with formation of a liquid phase, an alloy structure having particularly grown (001) planes is easily obtained when WC is grain-grown through a dissolution/re-deposition phenomenon. Due to the pressure sintering, further, the WC crystals are preferentially grown in a direction substantially vertical or perpendicular with respect to a pressure axis, whereby a section having particularly developed (001) planes of WC crystals can be obtained. The (001) planes exhibit the highest hardness in the WC crystals, and hence the inventive composite member provided with the cross section having the preferentially grown (001) planes presents an alloy section which is remarkably excellent in wear resistance, along with dispersion of superhard diamond. The inventive composite member may be so arranged on a sliding part or an impact part that the surface having the developed (001) planes serves as a working surface as needed.

(3) Assuming that V(001) and V(101) represent peak strength values of (001) and (101) planes of WC crystals by an X-ray diffraction technique on a section which is vertical i.e. perpendicular with respect to the pressure axis for direct resistance heating and pressurized sintering respectively, and H(001) and H(101) represent peak strength values of the (001) and (101) planes of the WC crystals by an X-ray diffraction technique on a section which is horizontal, i.e. parallel, with respect to the pressure axis respectively, V(001)/V(101) is larger than 0.5, and H(001)/H(101) is smaller than 0.45 respectively.

Orientation of WC crystals can be evaluated by X-ray diffraction. The JCPDS card describes that a peak strength ratio of a (001) plane to a (101) plane is 0.45, and it can be understood therefrom that an alloy having a value larger than 0.45 has an alloy structure with preferentially grown (001) planes. In the present invention, it has been discovered that particularly excellent characteristics can be attained due to the aforementioned restriction of peak strength by X-ray diffraction. Planes which are vertical and horizontal with respect to the pressure axis may be applied to surfaces requiring hardness and toughness respectively in response to the object, and the degree of freedom in design can be improved with respect to the conventional alloy. The term "pressure axis" indicates an axis in a pressurizing direction during sintering. Further, the term "section which is vertical with respect to the pressure axis" indicates a section of the composite member which is cut along a plane substantially perpendicular to the pressure axis, and the term "section which is horizontal with respect to the pressure axis" indicates a section of the composite member which is cut along a plane substantially parallel to the pressure axis.

(4) The binder phase contains Co, and the main crystal system of this Co is f.c.c.

When sintering is performed while allowing the appearance of a liquid phase, a dense superhard composite member having a high bonding strength of diamond grains can be obtained and the main crystal system of Co can be stabilized in f.c.c., and impact resistance is improved in this case. While a small amount of Co having a crystal system of h.c.p. may be mixed in the composition due short-time sintering at a low temperature and quenching, excellent impact resistance is maintained also in this case. In order to determine the main crystal system of Co, a surface is mirror-polished, and then WC on this surface is subjected to selective electrolytic etching and thereafter to X-ray diffraction. When the value of (peak strength of h.c.p.-Co(101))/(peak strength of f.c.c.-Co(200)) is smaller than 2.5, the main crystal system of this sample is decided to be or categorized as f.c.c. for the sake of convenience.

(5) The composite member has apparent porosity satisfying the range of A00 to A08 and B00 to B08 in ISO standards. Due to such a dense structure, a composite member having high diamond holding strength and excellent wear resistance can be obtained. The range up to A04 and B04 is particularly preferable. Further, at least 98% of theoretical specific gravity is preferably attained. It is possible to evaluate whether or not the composite member is dense by mirror-finishing a section of the member and observing its structure with an optical microscope.

(6) The liquid phase appearance temperature is higher than 1300° C.

Under such a temperature at which WC cemented carbide forms a liquid phase, the melting point of a eutectic composition is 1320° C., and reaction between diamond and cemented carbide can be expected at a sintering temperature of at least 1350° C. which is necessary for densely sintering the alloy, whereby a composite member having higher diamond holding strength than the prior art can be expected. While a temperature exceeding 1300° C. is considerably higher than that in the conventional method for sintering the material under diamond metastable conditions, the direct resistance heating and pressurized sintering according to the present invention enables rapid temperature rise and short-time sintering, whereby an excellent composite member can be manufactured while inhibiting transformation of diamond to graphite.

(7) Each diamond grain has an outer coating consisting of at least one metal selected from a group consisting of Ir, Os, Pt, Re, Rh, Cr, Mo and W.

While it has already been described that a sintering temperature exceeding 1300° C. is preferable for obtaining a dense sintered body of WC cemented carbide or TiC cermet, diamond or CBN is readily attacked by the formed liquid phase under such a condition. The aforementioned metal coating is remarkably effective for preventing this. When each diamond or CBN grain is completely coated with such a metal, a particularly excellent effect can be attained for preventing deterioration of diamond.

The thickness of the outer coating is preferably 0.1 to 50 $\mu$m. This is because no effect of the coating is attained if the thickness is less than 0.1 $\mu$m, while wear resistance for serving as a hard material is reduced if the thickness exceeds 50 $\mu$m. A particularly preferable range is 5 to 20 $\mu$m. This structure is not premised on the inner coating described below. In other words, the outer coating is effective independently of the inner coating.

(8) An inner coating consisting of at least one metal selected from Co and Ni is provided between the outer coating and each diamond grain.

When the inner coating of at least one metal selected from Co and Ni is provided between the outer coating and each diamond grain, it is possible to compensate for the disadvantageously small deformability of WC cemented carbide against application of a strong impact. Further, the holding strength for the diamond grains is improved, to attain particularly excellent performance. The thickness of the inner coating is preferably 0.1 to 100 μm. This is because no effect is attained if the thickness is less than 0.1 μm, while wear resistance for serving as a hard material is reduced if the thickness exceeds 100 μm. A particularly preferable range is 5 to 50 μm. The inner coating may alternatively be provided on each hard phase grain.

(9) At least one element selected from a group consisting of W, Ti, Co and Ni is diffused in the outer coating.

If diffusion of at least one element selected from W, Ti, Co and Ni is caused in the outer coating, bonding strength between the WC cemented carbide or TiC(N) cermet and the diamond grains coated with a metal is improved, to attain excellent performance.

(10) At least 50% of all of the WC crystals in area ratio in an arbitrary sectional structure are larger that 3 μm in grain size.

If WC crystals having grain sizes larger than 3 μm are contained to an extent of at least 50% of all WC crystals in area ratio, it is possible to provide a composite member having excellent characteristics against application of a strong impact to be employed for a mine civil engineering tool or the like.

(11)-[1] The mean grain size of WC forming the hard phase is smaller than 1 μm.

In this case, improvement in hardness can be attained due to the small grain sizes of WC.

(11)-[2] WC crystals which are smaller than 1 μm in grain size are contained to an extent of at least 10 to 35% of all WC crystals in area ratio in an arbitrary sectional structure.

When the WC crystals having grain sizes smaller than 1 μm are contained to an extent of 10 to 35% of all WC crystals in area ratio, the hardness of the cemented carbide is improved. Due to the small WC grain sizes, the liquid phase readily infiltrates into the WC grains by capillary action even in the short-time sintering according to the present invention, whereby the sintering property is preferably improved.

(12) The mean grain size of the WC is smaller than 3 μm, and that of the diamond grains is smaller than 10 μm. In particular, it is preferable that the mean grain size of the WC is 0.1 to 1.5 μm.

Due to this structure, an excellent composite member can be provided for application to a sliding wear resistant material such as a bearing for a machine tool or the like or a wood tool tip or a wire drawing die receiving relatively weak impact force. More preferably, the mean grain size of the WC is smaller than 1 μm, and that of the diamond grains is smaller than 3 μm.

(13) Free carbon is present in the interior.

If free carbon is present in the cemented carbide, i.e., when carbon is present in the binder phase in excess, it is possible to expect such an effect that the diamond is hardly dissolved as carbon in a liquid phase when the liquid phase is caused during sintering. This free carbon has excellent lubricity, whereby the composite member attains self lubricity when the same is applied to a sliding wear resistant material or the like.

(14) At least one component selected from carbides of elements belonging to the groups IVa, Va and VIa of the periodic table and Si is deposited on at least a part of the interface between the hard phase and the diamond.

When at least one element selected from the elements belonging to the groups IVa, Va and VIa of the periodic table and Si is employed as a raw material powder, this element reacts with carbon for forming a carbide even if diamond is dissolved as carbon in the liquid phase of the binder phase, to be capable of contributing to improvement in hardness of the composite member.

(15) The mean grain size of the diamond grains is 10 to 1000 μm.

Surface areas of fine diamond grains which are smaller than 10 μm in mean grain size are so large in relative terms that the diamond is readily transformed to carbon, while strength is disadvantageously reduced if the mean grain size of diamond exceeds 1000 μm. If the mean grain size of diamond is between these values, however, the diamond grains can be excellently embedded in the matrix so that they hardly drop out therefrom. Thus, the mean grain size of the diamond grains is preferably in this intermediate range.

(16) The content of the diamond grains is 5 to 50 vol. %.

No effect of dispersion of diamond can be expected if the diamond content is less than 5 vol. %. On the other hand, diamond grains directly come into contact with each other in so many portions that the bonding strength of the diamond grains with respect to the matrix is reduced to result in easy dropping out of the diamond grains if the diamond content exceeds 50 vol. %.

(17) The binder phase content is 10 to 50 vol. %.

The binder phase content in the composite member is preferably in the range of 10 to 50 vol. %, in order to advance dense sintering under a low temperature for a metastable state of diamond in a short time.

(18) The content of the diamond grains is varied in the thickness direction so that the amount of the diamond grains is increased toward one surface of the superhard composite member and reduced toward the other surface.

Due to this structure, a composite member having both hardness and toughness can be obtained. The thermal expansion coefficient is smaller on the side containing a larger amount of diamond grains as compared with the side containing a smaller amount of diamond grains, whereby compressive residual stress results in the former side so that a tough surface layer having excellent diamond holding power can be prepared.

The diamond content can be either stepwisely or continuously varied.

(19) The composite member is bonded onto a substrate containing at least one of WC cemented carbide, TiC(N) cermet and a metal material.

The metal material can be prepared from steel or the like. A thin insert member may be inserted between the composite member and the metal material, for suppressing voids due to a Kirkendall effect of the metal material. A member having both hardness and toughness can be obtained by connecting the composite member with the metal material. Bonding strength between the substrate and the composite member can be improved by increasing the binder phase content on the bonding surface side of the composite member. In addition, compressive residual stress can be advantageously generated on the surface in relation to the thermal expansion coefficient.

(20) The diamond grains are at least partially replaced with at least either cubic boron nitride or wurtzite boron nitride.

A dense sintered body can be prepared at a low temperature in a short time within 10 minutes due to the direct resistance heating and pressurized sintering to be capable of preventing quality deterioration of CBN or the like and suppressing reaction on the interface, whereby a superhard composite member which is superior in characteristic to the prior art can be manufactured.

Particularly in case of employing CBN, it is effective to satisfy at least one of the following conditions, for improving bonding power between CBN and the matrix:

[1] WC cemented carbide is employed for the matrix.

[2] The CBN content is 5 to 50 vol. %.

[3] Sintering is performed under thermodynamically metastable conditions with presence of a liquid phase.

[4] A binder phase allowing appearance of a liquid phase at a temperature higher than 1300° C. is employed.

On the other hand, a composite material according to the present invention contains at least one hard phase selected from a group consisting of WC, TiC and TiN, a binder phase mainly composed of an iron family metal, and a plurality of diamond grains dispersed in a structure having the hard phase and the binder phase, and comprises at least one of the following structures:

(1) Such a structure that the diamond grains form no skeletons; and (2) such a structure that there is no part where diamond grains are directly bonded to each other.

The composite material having the aforementioned structure includes that obtained by direct resistance heating and pressurized sintering as a matter of course, and that manufactured by another method.

Further, the aforementioned inventive composite material is preferably employed as a cutter bit for a shield machine.

In tunnel work or the like, the shield machine must continuously excavate portions between shafts without exchanging the cutter bit. Therefore, the cutter bit must not be chipped during excavation. In order to cope with this requirement, considerably hard cemented carbide is employed (refer to Japanese Patent Laying-Open No. 7-269293 (1995)) or the number of such cutter bits is increased (refer to Japanese Patent Laying-Open No. 6-74698 (1994)). However, the hard cemented carbide is readily reduced in toughness, and hence chipping is unavoidable. Further, increase of the number of bits leads to a high cost. While the distance of continuous excavation can be reduced by increasing the number of shafts, this leads to an increase of the term duration or the cost of the overall tunneling work. If the number of shafts is increased on the bottom of the sea or a river, the cost is extremely increased.

On the other hand, the inventive superhard composite material which has both excellent wear resistance of diamond and excellent toughness of cemented carbide can stably perform long-distance excavation, and thus exhibits remarkably excellent characteristics as a cutter bit material for a shield machine. Further, the inventive superhard composite material can be manufactured at a low cost without employing an ultra high-pressure vessel as is needed in the conventional process.

A superhard composite member according to still another aspect of the present invention comprises a hard phase mainly composed of WC, a binder phase mainly composed of Co, and a plurality of diamond grains dispersed in a structure having the hard phase and the binder phase, and comprises all of the following factors:

(1) The main crystal system of Co is f.c.c.

(2) The member has apparent porosity satisfying the range of A00 to A08 and B00 to B08 in ISO standards.

(3) The content of the diamond grains is 5 to 50 vol. %.

(4) There are no parts where the diamond grains are directly bonded to each other.

It has been impossible to manufacture a composite member of the aforementioned structure by a conventional method such as ultra high pressure sintering or conventional hot pressing. This is because diamond grains repeat a process of being dissolved in a liquid phase and re-deposited on the diamond grains to result in direct bonding between the diamond grains in the ultra high pressure sintering, which cannot satisfy the factor (4). According to the present invention, no such direct bonding is caused as described above, whereby excellent toughness can be exhibited by a superhard matrix containing 5 to 50 vol. % of the diamond grains (factor (3)).

In the conventional hot pressing, on the other hand, a sintered body comprising a hard phase mainly composed of WC, a binder phase mainly composed of Co and a plurality of diamond grains dispersed in a structure having the hard phase and the binder phase is obtained by low-temperature sintering, and hence no dense sintered body can be manufactured. Thus, the apparent porosity of the factor (2) satisfying A00 to A08 and B00 to B08 in ISO standards cannot be attained. Further, the main crystal system of Co is h.c.p., and this sintered body has an insufficient impact resistance level.

Thus, a superhard composite member comprising a hard phase mainly composed of WC, a binder phase mainly composed of Co and a plurality of diamond grains dispersed in a structure having the hard phase and the binder phase along with all of the factors (1) to (4) has superior characteristics as compared with the conventional member. While a direct resistance heating and pressurized sintering method is preferably employed as a method of manufacturing this member, the present invention is not restricted to this method.

A method of manufacturing the aforementioned composite member comprises the steps of mixing raw powder materials including diamond powder, hard phase powder and a binder phase with each other for obtaining a mixed raw material, and directly resistance heating the mixed raw material with application of a prescribed pressure for heating the mixed raw material to a prescribed temperature and sintering the same. In particular, the prescribed temperature is preferably at least 1100° C. and not more than 1350° C., and the prescribed pressure is preferably at least 5 MPa and not more than 200 MPa. More preferably, the prescribed pressure is at least 10 MPa and not more than 50 MPa, in order to be able to use a low-priced graphite mold.

Among the raw powder materials, diamond grains or the like may be provided with the aforementioned outer and/or inner coatings by well-known plating, CVD or PVD.

In the step of mixing the raw powder materials, mechanical alloying is preferably employed. Due to employment of the mechanical alloying, the hard phase powder is coated with the binder phase powder, whereby the sintering property is improved to facilitate densification.

A step of introducing the mixed raw material into a resistance heating apparatus for direct resistance heating and pressurized sintering includes a step of introducing the mixed powder into the resistance heating apparatus as such as a matter of course, or a step of introducing a previously pressed green compact, an intermediate sintered body, or a laminate. In order to form a connected body of the composite member and a substrate, a composite which is prepared by arranging the mixed raw material on the substrate may be introduced into the resistance heating apparatus.

If the sintering temperature is lower than 1100° C. or the pressure is lower than 5 MPa in the sintering step, it is difficult to achieve progress of the densification. If the mixed raw material is sintered at a temperature higher than 1350° C., on the other hand, the liquid phase is easy to exudate. The term "sintering temperature" indicates the temperature on a surface of a graphite mold at the time of controlling the amount of a current of a sintering apparatus. The actual sample temperature is conceivably higher than this temperature by 200° to 300° C. It is difficult to increase the pressure beyond 200 MPa in equipment, and this leads to a high cost.

The sintering time is preferably within 10 minutes. More preferably, the sintering time is within 3 minutes. At the sintering temperature exceeding 1100° C., the binder phase of cemented carbide is dissolved to form a liquid phase, and dissolves diamond which in turn is readily deposited as carbon. However, this reaction requires a long time, and hence transformation of diamond to carbon can be suppressed to the utmost by setting the liquid phase formation time within 10 minutes.

In order to manufacture a composite member whose diamond content is varied in the thickness direction, a plurality of types of mixed raw materials having different mixing ratios of diamond powder may be prepared in the step of obtaining the mixed raw material. These plurality of types of mixed raw materials are stacked in order of the diamond powder mixing ratios in the step of sintering the materials. A composite member having a composition which is stepwisely varied in the thickness direction can be obtained if the number of the types of the raw materials having different diamond powder mixing ratios is small, while a composite member having a substantially continuously varied composition can be obtained if the number of the types of the raw materials is large and the stacked layers are reduced in thickness. In order to connect the composite member having such an inclined or gradient composition onto a substrate, it is preferable to reduce the diamond content on the bonding surface side and to increase the diamond content on the free surface side. In this case, a portion of the composite member which is close to the bonding surface may contain absolutely no diamond grains.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Test Example 1

Commercially available diamond powder of 10 μm in mean grain size, WC powder of 2 μm in mean grain size, Co powder of 2 μm in mean grain size, TiC powder of 1.5 μm in mean grain size and Ni powder of 5 μm in mean grain size were employed for preparing blended powder materials of samples Nos. 1-1 to 1-7 in ratios (volume %) shown in Table 1 respectively, and these blended powder materials were wet-blended in a ball mill for 5 hours and thereafter dried.

TABLE 1

| Sample No. | Diamond | WC | TiC | Co | Ni | Rest |
|---|---|---|---|---|---|---|
| 1-1 | 5 | 70 | | 20 | | TaC 5 |
| 1-2 | 10 | 60 | 3 | 26 | 1 | |
| 1-3 | 15 | 5 | 50 | 10 | 15 | $Mo_2C$ 5 |
| 1-4 | 25 | 55 | | 20 | | |
| 1-5 | 35 | 40 | 5 | 15 | | Cr 5 |
| 1-6 | 50 | 10 | | 30 | | (Ti,Ta,W)C 10 |
| 1-7 | 70 | 5 | | 15 | 5 | NbC 5 |

Then, each dried powder was charged in a graphite mold, which in turn was so energized that the programming or heating rate was 250° C./min. with application of pressure of 20 MPa from above and below in a vacuum of not more than about 0.01 Torr, and kept at a temperature of 1150° C. for 2 minutes for sintering (the so-called resistance heating and pressurized sintering), and thereafter the powder was quenched.

The obtained sintered bodies of 20 mm in diameter and 5 mm in thickness were observed, to find no cracks on the samples. Further, the samples were surface-ground and the ground surfaces were observed with an optical microscope at 200× magnification, to find no pores on the samples.

Figure 1:
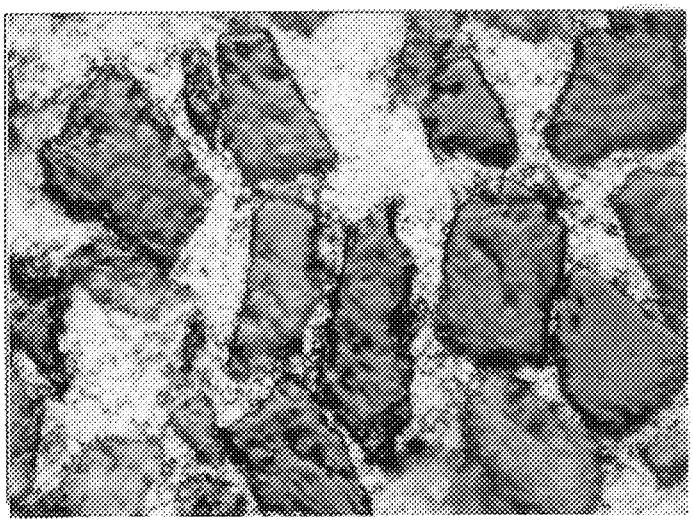
FIG. 1 is an optical microphotograph showing the structure of a superhard composite member according to the present invention.

Referring to FIG. 1, diamond grains appearing black in the structure of the sample No. 1-7 are bonded to each other and held by white cemented carbide grains. Presence of diamond was confirmed by X-ray diffraction, to find that diamond grains reliably remained in all samples.

Figure 2A:
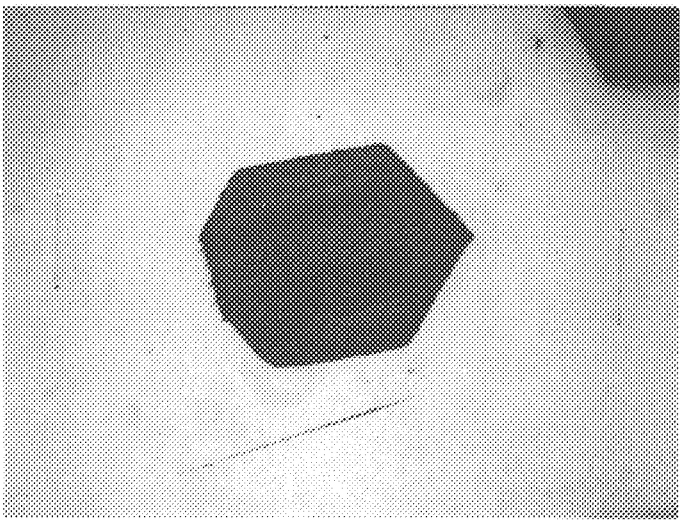
FIGS. 2A and 2B are optical microphotographs showing the structures of inventive and comparative hard composite members respectively.
Figure 2B:
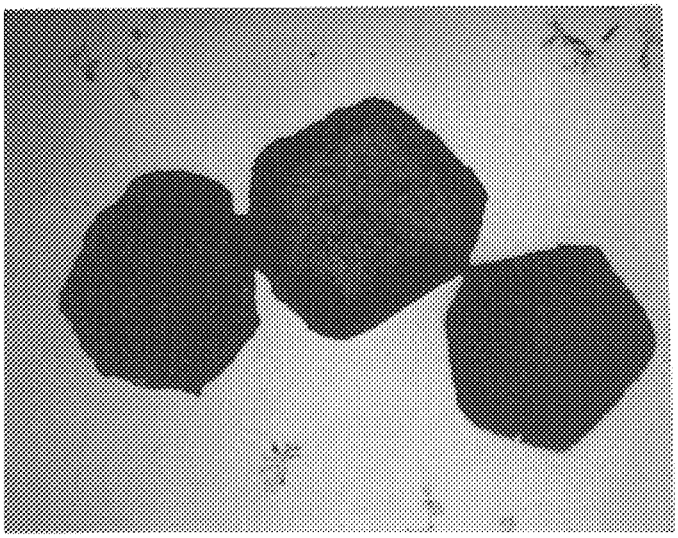

For the purpose of comparison, a sintered body was prepared by a conventional method under conditions of 1350° C., 1 hour and keeping in a vacuum. This comparative sample and the sintered body of the sample No. 1-4 were surface-ground and mirror-polished, and thereafter the structures thereof were photographed. As clearly understood from FIGS. 2A and 2B, deterioration conceivably resulting from graphitization is observed on the interface between diamond appearing black and WC in the comparative sample as shown in FIG. 2B, and diamond itself is damaged by cracking etc. On the other hand, neither deterioration nor damage is observed on the sintered body of the sample No. 1-4, as shown in FIG. 2A.

Test Example 2

A sample No. 2-1 was prepared with the same composition as the sample No. 1-4 of Test Example 1 except that only the direct resistance heating and pressurized sintering conditions were changed to a temperature of 1250° C. and a programming rate of 200° C./min. for generating a liquid phase and quenching the material without a holding period. The obtained sintered body was surface-ground with a #400 grinding stone, and finished into a disc of 20 mm in diameter and 5 mm in thickness.

This sintered body was sandblasted with SiC of 200 μm in mean grain size at 5 kg/cm$^2$ for 30 minutes for investigating the weight reduction ratio of the sintered body, which was 0.05%. On the other hand, the sintered body of the sample No. 1-4 was similarly sandblasted, to find that its weight reduction ratio was 0.3%. Thus, it has been proved that the sample No. 2-1 was by far superior in wear resistance.

Test Example 3

A sintered body of a sample No. 3-1 was prepared with the same composition as the sample No. 1-7 of Test Example 1 under conditions of a temperature of 1600° C. and pressure of 6 GPa with an ultra high-pressure vessel.

The sintered bodies of the samples Nos. 1-7 and 3-1 were dipped in aqua regia for dissolving Co and Ni. Consequently, the sample No. 1-7 was pulverized while the sample No. 3-1 exhibited substantially no shape change.

This is conceivably because diamond grains were not directly bonded to each other and formed no skeletons in the sample No. 1-7, while those in the sample No. 3-1 were directly bonded to each other to form skeletons under the ultra high-pressure conditions.

Test Example 4

A sintered body of a sample No. 4-1 was prepared with the same composition as the sample No. 1-4 similarly to Test Example 3, under conditions of a temperature of 1600° C. and pressure of 6 GPa with an ultra high-pressure vessel.

The sintered bodies of the samples Nos. 1-4 and 4-1 were surface-ground and then the ground surfaces were mirror-polished with diamond paste, and the polished surfaces were observed with an SEM and a TEM.

Consequently, it has been proved that diamond grains were directly bonded to each other in the sample No. 4-1, while no such bonding was caused in the sample No. 1-4.

Test Example 5

Samples Nos. 5-1 to 5-6 were prepared basically with the same composition as the sample No. 1-4 under the same sintering conditions as Test Example 2 while varying only diamond contents as shown in Table 2. Thus, the sample No. 5-4 was identical to the sample No. 2-1.

TABLE 2

| Sample No. | Diamond | WC | Co | Weight Reduction Ratio | Transverse Rupture Strength |
|---|---|---|---|---|---|
| 5-1 | 0 | 73.3 | 26.7 | 0.50% | 2.5 GPa |
| 5-2 | 5 | 69.7 | 25.3 | 0.25% | 2.1 GPa |
| 5-3 | 15 | 62.3 | 22.7 | 0.18% | 1.8 GPa |
| 5-4 | 25 | 55 | 20 | 0.05% | 1.5 GPa |
| 5-5 | 50 | 36.7 | 13.3 | 0.21% | 0.9 GPa |
| 5-6 | 80 | 14.7 | 5.3 | 0.43% | 0.7 GPa |

The respective samples were sandblasted similarly to Test Example 2. Table 2 also shows the weight reduction ratios of the sintered bodies along with transverse rupture strength. From the results shown in Table 2, it is understood that superior erosion resistance is attained when the content of diamond grains is in the range of 5 to 50 vol. %.

Test Example 6

Samples Nos. 5-4 and 6-1 to 6-5 were prepared with the same composition as the sample No. 1-4 under the same sintering conditions as Test Example 2, while varying only the mean grain sizes of diamond grains as shown in Table 3.

TABLE 3

| Sample No. | Diamond Grain Size | Weight Reduction Ratio | Transverse Rupture Strength |
|---|---|---|---|
| 5-4 | 10 μm | 0.05% | 1.5 GPa |
| 6-1 | 30 μm | 0.03% | 1.4 GPa |
| 6-2 | 100 μm | 0.04% | 1.2 GPa |
| 6-3 | 800 μm | 0.05% | 1.0 GPa |
| 6-4 | 1500 μm | 0.06% | 0.7 GPa |
| 6-5 | 3 μm | 0.14% | 1.8 GPa |

Table 3 also shows the weight reduction ratios and transverse rupture strength of the sintered bodies of the respective samples which were sandblasted similarly to Test Example 2. From the results shown in Table 3, it is understood that particularly superior erosion resistance is attained in the sintered body having average diamond grain diameter of 10 to 1000 μm.

Test Example 7

Sintered bodies of samples Nos. 7-1 to 7-4 were prepared by employing powder materials of compositions shown in Table 4 while varying only pressure to 100 MPa in the sintering conditions of Test Example 2.

TABLE 4

| Sample No. | Diamond Mean Grain Size 20 μm | WC | Co | Ti | Si | Cr | W | Zr | Raman Spectral Intensity |
|---|---|---|---|---|---|---|---|---|---|
| 7-1 | 30 | 55 | 15 | | | | | | 100% |
| 7-2 | 30 | 52 | 15 | 3 | | | | | 20% |
| 7-3 | 30 | 52 | 15 | | 1 | 2 | | | 15% |
| 7-4 | 30 | 52 | 15 | | | | 2 | 1 | 10% |

The obtained sintered bodies were mirror-finished and the mirror surfaces were spectrally analyzed by Raman spectroscopy. Consequently, the samples Nos. 7-2 to 7-4 exhibited small peak intensities assuming that the peak intensity of a Raman line of carbon detected in the sample No. 7-1 was 100%. Thus, it is understood that it is possible to suppress deposition of graphite during sintering by adding an element belonging to the group IVa, Va or VIa of the periodic table such as Ti or Cr, or Si.

Further, it has been confirmed by an X-ray diffraction technique that TiC was deposited in the sample No. 7-2, SiC and $Cr_2C_3$ were deposited in the sample No. 7-3, and ZrC was deposited in the sample No. 7-4. It has also been confirmed by observation with an SEM and EDX that the there deposits were generally observed to be located on diamond surfaces.

Test Example 8

A sample No. 8-1 was prepared similarly to the sample No. 7-1 with further addition of 5 wt. % of carbon for sintering. When the samples Nos. 7-1 and 8-1 were mirror-polished, holes conceivably resulting from diamond grains that were graphitized and dropped out during the mirror polishing were partially observed in portions around the diamond grains in the sample No. 7-1. On the other hand, portions around the diamond grains were normal and the presence of free carbon was confirmed through observation with an optical microscope of 200× magnification in the sample No. 8-1.

Further, the samples Nos. 7-1 and 8-1 were sandblasted similarly to Test Example 2, whereby it was determined that the weight reduction ratio of the sample No. 7-1 was 0.04% while the sample No. 8-1 had a small weight reduction ratio of 0.02%. Thus, the sample No. 8-1 was superior in erosion resistance.

Test Example 9

Samples Nos. 9-1 to 9-6 having compositions shown in Table 5 were prepared under the same sintering conditions as Test Example 2. These samples were sandblasted similarly to Test Example 2, whereby the weight reduction ratios shown in Table 5 were determined. From these results, it is decided that the content of an iron family metal forming a binder phase is preferably in the range of 10 to 50 vol. %.

TABLE 5

| Sample No. | Diamond Mean Grain Size 30 μm | WC | Co | Ni | Weight Reduction Ratio |
|---|---|---|---|---|---|
| 9-1 | 30 | 65 | 3 | 2 | 0.51% |
| 9-2 | 30 | 60 | 10 | 0 | 0.18% |
| 9-3 | 30 | 45 | 20 | 5 | 0.05% |
| 9-4 | 30 | 30 | 30 | 10 | 0.09% |
| 9-5 | 30 | 20 | 40 | 10 | 0.21% |
| 9-6 | 30 | 10 | 60 | 0 | 0.39% |

Test Example 10

Samples Nos. 10-1 to 10-5 were prepared by employing powder materials having the same composition as the sample No. 1-5 in Test Example 1, heating the materials to 1200° C. at a programming rate of 100° C./min., keeping or continuing these conditions for times shown in Table 6 for performing direct resistance heating and pressurized sintering, and then quenching the materials at 100° C./min.

Table 6 also shows specific gravity values of the respective samples. The presence or absence of diamond in the sintered bodies was examined by an X-ray diffraction technique, whereby diamond peaks were observed in all samples. Further, the sintered bodies were mirror-polished and thereafter observed with an optical microscope, to find the results shown in Table 6. Thus, it is understood that the holding time at a temperature of at least 1150° C. is preferably within, i.e. not greater than, 10 minutes.

TABLE 6

| Sample No. | Keeping Time | Holding Time at Temperature exceeding 1150° C. | Specific Gravity (g/cm$^3$) | Diamond Peak in X-Ray Diffraction | Apparent Porosity |
|---|---|---|---|---|---|
| 10-1 | 0 | 1 min. | 9.91 | yes | porous (B04) |
| 10-2 | 1 min. | 2 min. | 9.99 | yes | slightly porous (A04) |
| 10-3 | 2 min. | 3 min. | 10.05 | yes | unporous (A02) |
| 10-4 | 7 min. | 8 min. | 10.01 | yes | slightly porous (A02–A04) |
| 10-5 | 15 min. | 16 min. | 9.88 | yes | diamond remarkably dropped out |

Test Example 11

A sample No. 11-1 was prepared under the same conditions as the sample No. 10-1 of Test Example 10 while employing diamond powder subjected to electroless plating of Co before sintering. Consequently, the specific gravity was improved to 10.05, and an apparent porosity was confirmed by observation with an optical microscope. Thus, it is understood that the sintered body can be readily densified by employing powder which is prepared by coating diamond powder with Co by plating.

Test Example 12

Powder materials of the same compositions as the samples Nos. 10-1 to 10-5 of Test Example 10 were dry-blended in a ball mill for 24 hours. A section of the obtained powder was observed with an SEM, to confirm that diamond, WC and TiC were embedded in Co and mechanically alloyed. This powder was employed for preparing a sample No. 12-1 under the same sintering conditions as the sample No. 10-1. Consequently, the specific gravity was improved to 10.04, and annihilation of pores was confirmed by observation with an optical microscope. Thus, it has been understood that the sintered body is readily densified when mechanical alloying is employed for the step of mixing powder materials consisting of diamond, WC, TiC and Co.

Test Example 13

Powder materials having compositions (vol. %) shown in Table 7 were pressed in layers and charged in a graphite mold, which in turn was supplied with a current so that the programming rate was 200° C./min. with application of a pressure of 50 MPa from above and below and kept at a temperature of 1200° C. for 1 minute for performing direct resistance heating and pressurized sintering, and thereafter quenched. The obtained discoidal sintered body of 50 mm in diameter and 20 mm in thickness was observed, to find no cracks between the layers, which were excellently bonded with each other. A section of the sintered body along the thickness direction was mirror-polished and its composition was analyzed with an EPMA and an AES, to find that movement of the elements between the respective layers was relatively small and diffusion of the components between the layers, which was disadvantageously caused in the conventional sintered body, was suppressed.

The inventive sintered body has excellent wear resistance due to the diamond contained in the surface layer, while high strength and toughness can be attained due to cemented carbide or steel forming the internal layer. Thus, the inventive member can attain compatibility between these characteristics, which generally conflict with each other. Further, this member achieves the important advantage of being manufactured at a low cost without employing an ultra high-pressure vessel.

TABLE 7

| | Diamond | WC | Co | Fe | C | Thickness of Sintered Body mm |
|---|---|---|---|---|---|---|
| First Layer | 30 | 50 | 20 | | | 5 |
| Second Layer | | 70 | 30 | | | 5 |
| Third Layer | | | | 98 | 2 | 10 |

Test Example 14

Figure 3:
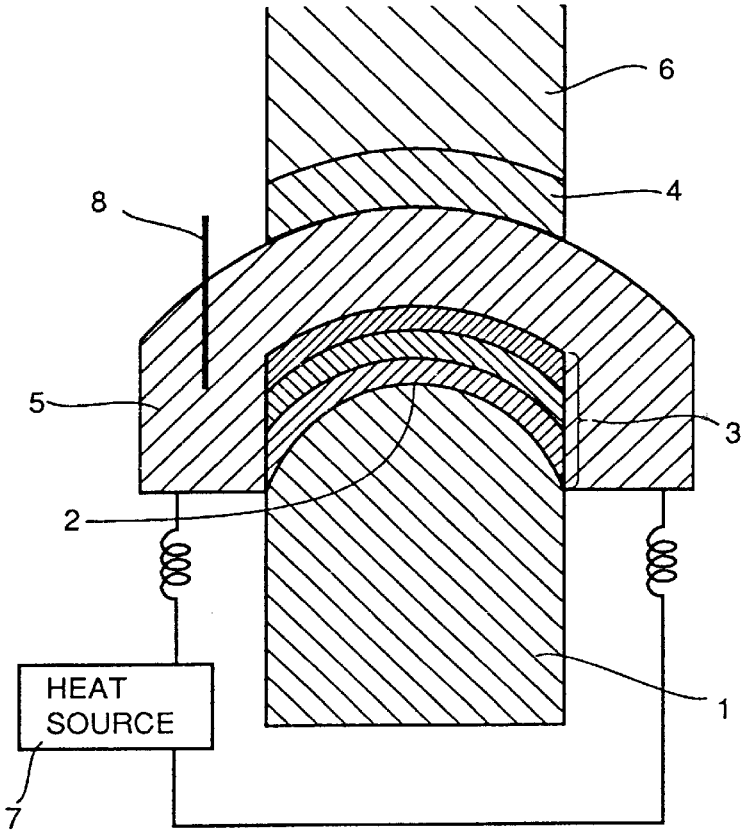
FIG. 3 schematically illustrates an apparatus for integrally sintering and connecting raw material powder for a superhard composite member with a steel substrate.

Referring to FIG. 3, each of mixed powder materials 3 having the compositions of Test Example 5 was charged on a spherical end surface 2 of a steel substrate 1 in a pressure heating apparatus, and sintered under the same sintering conditions as Test Example 5 so that each sintered body was sintered and bonded onto the end surface 2 of the substrate 1. The resistance heating apparatus shown in FIG. 3 has a heater 5 of graphite corresponding to the shape of each raw material powder 3 on the substrate 1, and this heater 5 is pressed against the substrate 1 by an upper pressure ram 6, for heating a pressed laminate. A heat insulator 4 of $Si_3N_4$ is interposed between the heater 5 and the pressure ram 6. Sintering is performed by energizing the heater 5 by a dc power source for heating, i.e. a heat source 7. The temperature of the heater 5 is controlled by a thermocouple 8 of $Si_3N_4$. The bottom surface of the substrate 1 is air-cooled. The raw material powder 3 is heated from its surface side, so that a temperature gradient can be formed with a higher temperature on the surface side and a lower temperature on the bonding interface. While the substrate 1 is also exposed to a high temperature in a conventional sintering furnace, the resistance heating apparatus shown in FIG. 3 can suppress or avoid a temperature rise of the substrate 1, for preventing annealing of the quenched steel substrate.

The charged mixed powder 3 may be prepared from only a single layer of the sample No. 5-4 of Test Example 5 or formed in a multilayer structure as shown in FIG. 3 so that the layer which is in contact with the end surface 2, the next layer and the outermost layer are formed by the samples Nos. 5-2, 5-3 and 5-4 respectively. In the case of the multilayer structure, it is possible to obtain a composite member in such a structure that the outermost layer has high hardness and the remaining layers have high toughness. A sintered body of such a multilayer structure was connected or bonded with a substrate in the aforementioned apparatus, whereby the substrate and the sintered body were excellently bonded together, as were the respective layers.

Figure 4:
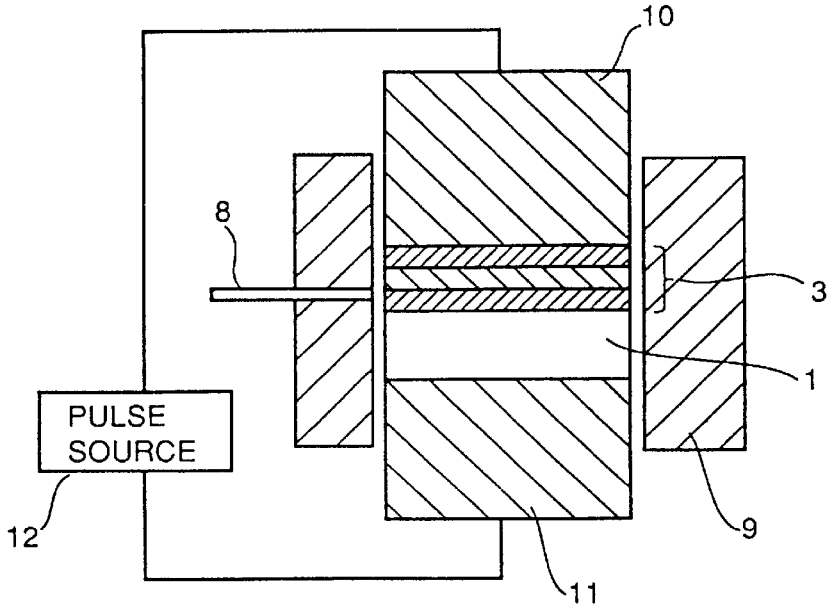
FIG. 4 schematically illustrates an apparatus having a structure different from that of FIG. 3.

According to the present invention, a raw material member 3 and a substrate 1 may be arranged in a carbon outer frame 9 as shown in FIG. 4, so that direct resistance heating and pressurized sintering can be carried out while applying pressure by upper and lower punches 10 and 11 and feeding a pulse current by a pulse source 12. The temperature is controlled by a thermocouple 8.

Test Example 15

A surface (V surface/V section) of the sample No. 1-4 of Test Example 1 vertical or perpendicular with respect to a pressure axis and a surface (H surface/H section) horizontal or parallel with respect to the pressure axis were subjected to X-ray diffraction through a Cu-Kα line.

Assuming that V(001) and V(101) represent peak strength values of (001) and (101) planes on the V section respectively and H(001) and H(101) represent peak strength values of the (001) and (101) planes on the H section respectively, Table 8 shows values of V(001)/V(101) and H(001)/H(101) in the aforementioned case respectively.

TABLE 8

| Sample No. | V(001)/V(101) | H(001)/H(101) | Main Crystal Grain Size of WC (μm) | Flank Wear (mm) |
|---|---|---|---|---|
| 1–4 | 0.26 | 0.38 | 0.3 | chipped in 3 min. 41 sec. |
| 15–1 | 0.48 | 0.47 | 1.5 | chipped in 2 min. 39 sec. |
| 15–2 | 0.50 | 0.42 | 0.3 | 0.40 |
| 15–3 | 0.55 | 0.38 | 0.3 | 0.37 |
| 15–4 | 0.59 | 0.37 | 0.3 | 0.32 |
| 15–5 | 0.63 | 0.35 | 0.3 | 0.25 |

Further, a sample No. 15-1 was prepared in the same composition as the sample No. 1-4 under conditions similar to those in Test Example 3 except that the mean grain size of WC was changed to 1.5 μm, with employment of an ultra high-pressure vessel, and subjected to x-ray diffraction. In addition, samples Nos. 15-2, 15-3 and 15-4 were prepared from the same powder materials as the sample No. 15-1 in the method of Test Example 1 with a keeping time of 2 minutes while setting only the sintering temperatures at 1200° C., 1250° C. and 1300° C. respectively, and a sample No. 15-5 was prepared at a sintering temperature of 1300° C. for a keeping time of 10 minutes, to be similarly subjected to X-ray diffraction. Table 8 also shows the results of these samples, along with the mean grain sizes of WC in the respective samples.

The sintered bodies prepared in the aforementioned manner were worked into shapes of ISO No. RNGN120400 so that V and H surfaces defined rake faces and flanks respectively, and cutting edges were chamfered by 0.2×–25°, and were then used for cutting granite workpieces under the following cutting conditions:

Cutting Speed: 50 m/min.

Feed Rate: 0.2 mm/rev.

Depth of Cut: 1.0 mm

Cutting Oil: not used

Table 8 also shows flank wear widths after working for 5 minutes. From the results shown in Table 8, it is understood that the samples Nos. 15-2, 15-3, 15-4 and 15-5 exhibited superior wear resistance to the sample 15-1 exhibiting no orientation to a specific direction.

The samples 15-2, 15-3, 15-4 and 15-5 having the values V(001)/V(101) of at least 0.5 and the values H(001)/H(101) of not more than 0.45 exhibited particularly excellent cutting performance. This is conceivably because the (001) planes exhibiting the maximum hardness in WC crystals were preferentially grown in the rake face directions in these samples and hence it was possible to suppress flaking (chipping on the rake faces), which is easily caused in case of cutting a hard rock.

Test Example 16

Sintered bodies were prepared from raw powder materials of the same composition as the sample No. 1-1 of Test Example 1 under conditions similar to those in Test Example 1, except that the sintering was carried out at temperatures of 1000° C., 1100° C., 1200° C. and 1300° C. respectively. Rake faces of these sintered bodies were lapped and the presence or absence of pores in WC-Co phases was observed with an optical microscope of 200× magnification. The results of the observation were classified in the range of A00 to B08 on the basis of ISO standards. Table 9 shows the results, along with transverse rupture strength of the respective sintered bodies.

In order to confirm actual temperatures of the respective samples during keeping or holding times, a graphite mold was perforated for allowing provision of a thermocouple in contact with the samples, and the actual sintering temperatures were measured by providing a sheathed PR thermocouple. Table 9 also shows the results.

TABLE 9

| Sample No. | Sintering Temperature (°C.) | Actual Sintering Temperature (°C.) | Apparent Porosity | Transverse Rupture Strength (GPa) |
|---|---|---|---|---|
| 16-1 | 1000 | 1180 | more porous than B08 | 1.3 |
| 16-2 | 1100 | 1295 | A08, B06 | 1.5 |
| 16-3 | 1200 | 1390 | A04, B00 | 1.9 |
| 16-4 | 1300 | 1510 | A02, B00 | 2.1 |

As shown in Table 9, it has been possible to confirm that the samples Nos. 16-3 and 16-4 containing type A pores in the range up to A04 with no type B pores were particularly dense and exhibited excellent characteristics. According to this test, the controlled sintering temperatures are lower by about 200° C. than the actual sintering temperatures. It is conceivable that this difference varies with the graphite mold being used and the sizes of the samples.

Test Example 17

Sintered bodies of samples Nos. 17-1, 17-5 and 17-10 were prepared to be 30 mm square with thicknesses of 5 mm by employing powder materials having the compositions of the samples Nos. 1-1, 1-3 and 1-5 shown in Table 1, feeding a current to a graphite mold in a vacuum of 0.005 Torr under 40 MPa pressure so that the programming rate was 200° C./min., keeping the graphite mold at 1150° C. for 1 minute for direct resistance heating and pressurized sintering, and then quenching the same. On the other hand, sintered bodies of samples Nos. 17-2 to 17-4, 17-6 to 17-9 and 17-11 were prepared by employing raw powder materials of the same compositions as the above while coating only diamond grains with metals such as Ir, Os, Pt, Re, Rh, Cr, Mo, W and the like by electroplating in thicknesses of about 5 μm. The sample No. 17-7 had two coating layers consisting of outer and inner layers of W and Cr respectively on the diamond surface.

The sintered bodies prepared in the aforementioned manner were surface-ground with a grinding stone of #250, and sandblasted under a pressure of 10 kg/cm$^2$ for 60 minutes, similarly to Test Example 2.

Table 10 shows the weight reduction ratios in this test.

TABLE 10

| Sample No. | Raw Material Composition | Coating Layer (μm) | Weight Reduction Ratio (%) | Transverse Rupture Strength (GPa) |
|---|---|---|---|---|
| 17-1 | No. 1 | no | 0.61 | 2.0 |
| 17-2 | No. 1 | Pt 2 | 0.36 | 2.3 |
| 17-3 | No. 1 | Rh 3 | 0.21 | 2.4 |
| 17-4 | No. 1 | Cr 5 | 0.28 | 2.2 |
| 17-5 | No. 3 | no | 0.46 | 1.7 |
| 17-6 | No. 3 | Mo 10 | 0.35 | 1.9 |
| 17-7 | No. 3 | outer layer W3 - inner layer Cr$^2$ | 0.31 | 2.0 |
| 17-8 | No. 3 | Re 2 | 0.23 | 2.3 |
| 17-9 | No. 3 | Ir 5 | 0.25 | 2.2 |
| 17-10 | No. 5 | no | 0.23 | 1.4 |
| 17-11 | No. 5 | Os 3 | 0.11 | 1.8 |
| 17-12 | No. 5 | Ti 3 | 0.31 | 1.9 |
| 17-13 | No. 5 | Zr 5 | 0.28 | 1.5 |
| 17-14 | No. 5 | V 5 | 0.29 | 1.5 |

Consequently, it was possible to confirm that the weight reduction ratios were reduced and thus the wear resistance was improved in the samples employing diamond grains coated with the metals such as Ir, Os, Pt, Re, Cr, Mo, W and the like as compared with the samples not coated with such metals. To our surprise, it has also been proved that transverse rupture strength of a sintered body employing diamond grains having metal coatings is improved.

For the purpose of comparison, samples Nos. 17-12 to 17-14 were prepared by coating diamond grains with Ti and Zr. In each of these samples, however, wear resistance was reduced as compared with the sample No. 17-10 having no coating. It is conceivable that such performance difference in wear resistance between the different types of coating metals depends on whether or not diamond can be protected against attack by a liquid phase formed in the sintering step. In other words, it is conceivable that the coating metal forms a solid phase during the formation of a liquid phase to be capable of preventing the diamond from coming into contact with the liquid phase.

Test Example 18

Sintered bodies of samples Nos. 18-3 and 18-7 were prepared by forming Co and Ni coating layers of 10 μm and 20 μm in thickness between the sintered bodies of the samples Nos. 17-3 and 17-7 of Test Example 17, the diamond grains of these samples and outer coatings of Rh and W/Cr respectively by electroplating. Table 11 shows Charpy impact values of these samples.

TABLE 11

| Sample No. | Charpy Impact Value (MPa · m) |
|---|---|
| 17-3 | 0.051 |
| 17-7 | 0.062 |
| 18-3 | 0.064 |
| 18-7 | 0.077 |

It is understood from Table 11 that the Charpy impact values were improved by forming the Co and Ni coating layers between the diamond grains and the outer coatings. The inventive diamond-dispersed superhard composite member is deteriorated in impact strength as compared with a simple superhard member due to the dispersion of diamond, and readily chipped when the same is applied to a rock bit or the like, for example. However, the impact strength can be improved by forming Co and Ni coating layers.

The presence or absence of other metal elements in the outer coatings of the samples Nos. 17-1 to 17-14, 18-3 and 18-7 was investigated by Auger electron spectroscopy, to prove that W, Co and Ni were diffused in the outer coatings along with Ti only in the samples Nos. 17-5 to 17-14 and 18-7. It is conceivable that holding or bonding power for the diamond grains was improved by these diffused elements.

Test Example 19

Six types of press powder materials having different blending ratios were prepared from WC powder A of 5 μm in mean grain size, WC powder B of 2 μm in mean grain size, WC powder C of 0.5 μm in mean grain size, 20 vol. % of Co powder of 2 μm in mean grain size, and 5 vol. % of diamond powder of 100 μm in mean grain size. These powder materials were subjected to direct resistance heating and pressurized sintering at a programming rate of 100° C./min. and a sintering temperature of 1200° C. for a keeping or holding time of 1 minute, and thereafter quenched for obtaining sintered bodies of samples Nos. 19-1 to 19-6. Structure photographs of the sintered bodies taken at 5000× magnification were digitized by a binary pixel representation for thereafter measuring grain size distributions of WC through an image analyzer. Further, these sintered bodies were subjected to a Charpy impact test and a three-point bending test with a span of 20 mm. Table 12 shows the results.

TABLE 12

| Sample No. | Abundance Raio of WC Grains Larger than 3 μm (%) | Abundance Ratio of WC Grains of 1 to 3 μm (%) | Abundance Ratio of WC Grains Smaller than 1 μm (%) | Charpy Impact Value (MPa · m) | Transverse Rupture Strength (GPa) |
|---|---|---|---|---|---|
| 19-1 | 17 | 21 | 62 | 0.051 | 2.8 |
| 19-2 | 43 | 17 | 40 | 0.056 | 2.5 |
| 19-3 | 52 | 41 | 7 | 0.064 | 1.7 |
| 19-4 | 78 | 17 | 5 | 0.068 | 1.5 |
| 19-5 | 65 | 23 | 12 | 0.067 | 2.2 |
| 19-6 | 63 | 5 | 32 | 0.065 | 2.6 |

As shown in Table 12, the Charpy impact values of the samples Nos. 19-3 to 19-6 having abundance ratios of WC grains having sizes larger than 3 μm in excess of 50% were relatively higher than those of the remaining samples, and these samples are conceivably suitable for an application requiring impact resistance. Further, it has been possible to confirm that the samples Nos. 19-5 and 19-6 having the abundance ratios of the WC grains having sizes smaller than 1 μm within the range of 10 to 35% exhibited excellent values as to transverse rupture strength, and had excellent performance balance.

Test Example 20

Sintered bodies of samples Nos. 20-1 to 20-9 were prepared under the same conditions as Test Example 19 except that the grain sizes of the WC and diamond powder materials were different. The diamond and Co contents were fixed at 30 vol. % and 15 vol. % respectively. These sintered bodies were subjected to a cutting test under cutting conditions similar to those in Test Example 15. Table 13 shows abrasion loss values.

TABLE 13

| Sample No. | Mean Grain Size of WC (μm) | Mean Grain Size of Diamond (μm) | Flank Wear (mm) |
|---|---|---|---|
| 20-1 | 5.6 | 50 | 0.48 |
| 20-2 | 2.6 | 50 | 0.33 |
| 20-3 | 0.8 | 50 | 0.15 |
| 20-4 | 5.6 | 8.5 | 0.41 |
| 20-5 | 2.6 | 8.5 | 0.22 |
| 20-6 | 0.8 | 8.5 | 0.13 |
| 20-7 | 5.6 | 2.7 | 0.38 |
| 20-8 | 2.6 | 2.7 | 0.15 |
| 20-9 | 0.8 | 2.7 | 0.09 |

It is understood from Table 13 that the sintered bodies having WC mean grain sizes of not more than 3 μm, particularly not more than 1 μm, are superior in wear resistance, and the sintered bodies having diamond mean grain sizes of not more than 10 μm are further superior in wear resistance. Thus, it is understood preferable that the mean grain sizes of WC and diamond are not more than 1 μm and not more than 10 μm respectively.

Test Example 21

Samples Nos. 21-1 to 21-7 were prepared by partially or entirely replacing the diamond of the samples Nos. 1-1 to 1-7 with CBN or WBN of 5 μm or 10 μm in mean grain size under the same conditions, for forming sintered bodies of 20 mm in diameter and 5 mm in thickness.

TABLE 14

| Sample No. | CBN vol % | WBN | Diamond | WC | TiC | Co | Ni | Rest |
|---|---|---|---|---|---|---|---|---|
| 21-1 | 5 | 0 | 0 | 70 | | 20 | | TaC 5 |
| 21-2 | 5 | 5 | 0 | 60 | 3 | 26 | 1 | |
| 21-3 | 0 | 10 | 5 | 5 | 50 | 10 | 15 | $Mo_2C$ 5 |
| 21-4 | 25 | 0 | 0 | 55 | | 20 | | |
| 21-5 | 30 | 0 | 5 | 40 | 5 | 15 | | Cr 5 |
| 21-6 | 30 | 10 | 10 | 10 | | 30 | | (Ti,Ta,W)C10 |
| 21-7 | 0 | 70 | 0 | 5 | | 15 | 5 | NbC 5 |

These sintered bodies were surface-ground with a #250 diamond grindstone, lapped and thereafter observed with an optical microscope. Consequently, neither cracking nor dropping out of CBN grains was observed in any sample, but dense sintered bodies were obtained.

Test Example 22

The samples Nos. 1-1 to 1-7, 3-1 and 4-1 of Test Examples 1, 3 and 4 and samples Nos. 22-1 and 22-2 prepared from raw materials of the same compositions as the samples Nos. 3-1 and 4-1 by employing an external heating type hot press under conditions of a temperature of 1000° C., pressure of 30 MPa and a keeping time of 1 hour were surface-ground, the ground surfaces were mirror-polished with diamond paste, thereafter the samples were observed with an SEM, WC was subjected to selective electrolytic etching, and thereafter the samples were subjected to X-ray diffraction, for measurement of items shown in Table 15. Table 15 also shows the results of the measurement.

TABLE 15

| Sample No. | Composition (vol %) Diamond | WC | No | Co | Ni | Rest | Main Crystal System of Co | Apparent Porosity | Presence/Absence of Parts where Diamond Grains Are Directly Connected with Each other | Preferable Sample |
|---|---|---|---|---|---|---|---|---|---|---|
| 1-1 | 5 | 70 | | 20 | | TaC 5 | fcc | A04, B02 | absent | ○ |
| 1-2 | 10 | 60 | 3 | 26 | 1 | | fcc | A04, B02 | absent | ○ |
| 1-3 | 15 | 5 | 50 | 10 | 15 | $Mo_2C$ 5 | fcc | A08, B04 | absent | |
| 1-4 | 25 | 55 | | 20 | | | fcc | A04, B02 | absent | ○ |
| 1-5 | 35 | 40 | 5 | 15 | | Cr 5 | fcc | A04, B02 | absent | ○ |
| 1-6 | 50 | 10 | | 30 | | | fcc | A04, B02 | absent | ○ |
| 1-7 | 70 | 5 | | 15 | 5 | NbC 5 | fcc | A06, B08 | absent | |
| 3-1 | 70 | 5 | | 15 | 5 | NbC 5 | fcc | A02, B02 | present | |
| 4-1 | 25 | 55 | | 20 | | | fcc | A02, B02 | present | |
| 22-1 | 70 | 5 | | 15 | 5 | NbC 5 | hcp | | absent | |
| 22-2 | 23 | 55 | | 20 | | | hcp | A02, B02 | absent | |

Further, the sintered bodies of the aforementioned samples were subjected to a cutting test for cutting sandstone workpieces under the following conditions, for measurement of abrasion loss values. As to those of the samples chipped during cutting, Table 16 shows times up to such chipping. Table 16 also shows Charpy impact values. The cutting conditions were a cutting speed of 100 m/min., a feed rate of 0.2 mm/rev., a depth of cut of 0.3 mm, a time of 5 minutes, and a dry type. From the results shown in Table 16, it is understood that the superhard composite members of the samples Nos. 1-1, 1-2, 1-4, 1-5 and 1-6 each comprising a hard phase mainly composed of WC, a binder phase mainly composed of Co, and a plurality of diamond grains dispersed in a structure having the hard phase and the binder phase and satisfying all of the factors: (1) the main crystal system of Co is f.c.c.; (2) the member has apparent porosity satisfying the range of A00 to A08 and B00 to B08 in ISO standards; (3) the content of the diamond grains is 5 to 50 vol. %; and (4) there are no parts where the diamond grains are directly bonded to each other; have superior performance as compared with the samples Nos. 1-3, 1-7, 3-1, 4-1, 22-1 and 22-2 not satisfying the aforementioned conditions.

TABLE 16

| Sample No. | Abrasion Loss (mm) | Charpy Impact Value (MPa · m) | Preferable Sample |
|---|---|---|---|
| 1-1 | 0.79 | 0.045 | ○ |
| 1-2 | 0.58 | 0.048 | ○ |
| 1-3 | chipped in 2 min. 15 sec. | 0.027 | |
| 1-4 | 0.46 | 0.039 | ○ |
| 1-5 | 0.34 | 0.035 | ○ |
| 1-6 | 0.29 | 0.043 | ○ |
| 1-7 | chipped in 1 min. 37 sec. | 0.028 | |
| 3-1 | chipped in 54 sec. | 0.021 | |
| 4-1 | chipped in 1 min. 49 sec. | 0.029 | |
| 22-1 | chipped in 25 sec. | 0.017 | |
| 22-2 | chipped in 42 sec. | 0.024 | |

According to the present invention, as hereinabove described, it is possible to obtain a strong superhard member strongly holding or bonding dispersed diamond grains, which is remarkably excellent in hardness and wear resistance by incorporating cemented carbide or cermet having high strength and toughness without employing an ultra high-pressure vessel.

Therefore, the inventive member can be applied to a mine civil engineering tool such as a casing bit, an earth auger bit, a shield cutter bit or the like, a cutting tool such as a tip for working wood, metal or resin, a bearing for a machine tool, a wear-resistant material such as a nozzle, a plastic working tool such as a wire drawing die, a grinding tool or the like.

According to the inventive method, it is possible to obtain a dense superhard composite member which is excellent in hardness and wear resistance by performing sintering in a short time. Further, the temperature rising time, the holding time and the cooling time can be shortened, whereby further cost reduction can be expected as compared with the prior art.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A superhard composite member comprising:

a hard phase consisting of a material containing at least one element selected from a group of WC, TiC, TiN and Ti(C,N);

a binder phase being mainly composed of an iron family metal; and a plurality of diamond grains being dispersed in a structure including said hard phase and said binder phase;

wherein said hard phase, said binder phase and said diamond grains have been formed by direct resistance heating and pressurized sintering under such conditions that diamond is thermodynamically metastable and a liquid phase is present; and wherein said composite member has apparent porosity satisfying the range of A00 to A08 and B00 to B08 according to ISO standards.

2. The superhard composite member in accordance with claim 1, wherein said hard phase is WC, and said binder phase is Co.

3. The superhard composite member in accordance with claim 1, wherein said binder phase contains Co having a main crystal system being f.c.c.

4. The superhard composite member in accordance with claim 1, wherein said conditions include a temperature allowing appearance of said liquid phase that is higher than 1300° C.

5. The superhard composite member in accordance with claim 1, wherein each said diamond grain comprises a core and an outer coating on said core, wherein said outer coating consists of at least one metal selected from a group consisting of Ir, Os, Pt, Re, Rh, Cr, Mo and W.

6. The superhard composite member in accordance with claim 5, wherein each said diamond grain further comprises an inner coating consisting of at least one metal selected from Co and Ni that is provided between said outer coating and said core of each said diamond grain.

7. The superhard composite member in accordance with claim 5, comprising at least one element selected from a group consisting of W, Ti, Co and Ni diffused in said outer coating.

8. The superhard composite member in accordance with claim 2, containing crystals of said WC, wherein at least 50% of all of said crystals of WC have a grain size larger than 3 μm as determined in an area ratio on an arbitrary cross section through said composite member.

9. The superhard composite member in accordance with claim 2, containing crystals of said WC, wherein at least 10% to 35% of all of said crystals of WC have a grain size smaller than 1 μm as determined in an area ratio on an arbitrary cross section through said composite member.

10. The superhard composite member in accordance with claim 2, wherein said WC has a mean grain size smaller than 1 μm.

11. The superhard composite member in accordance with claim 2, wherein said WC has a mean grain size smaller than 3 μm, and said diamond grains have a mean grain size smaller than 10 μm.

12. The superhard composite member in accordance with claim 2, having a section plane on which (001) planes of crystals of said WC are particularly developed.

13. The superhard composite member in accordance with claim 12, wherein V(001)/V(101) is larger than 0.5 and H(001)/H(101) is smaller than 0.45, wherein V(001) and V(101) respectively represent peak strength values of (001) and (101) planes of said WC crystals by X-ray diffraction on a first section plane which is perpendicular with respect to a pressure axis for said direct resistance heating and pressurized sintering, and H(001) and H(101) respectively represent peak strength values of said (001) and (101) planes of said WC crystals by X-ray diffraction on a second section plane which is parallel with respect to said pressure axis.

14. The superhard composite member in accordance with claim 1, comprising free carbon present in an interior of said composite member.

15. The superhard composite member in accordance with claim 1, having an interface between said hard phase and said diamond grains, and comprising at least one component being selected from carbides of elements belonging to the groups IVa, Va and VIa of the periodic table and SiC deposited on at least a part of said interface between said hard phase and said diamond grains.

16. The superhard composite member in accordance with claim 1, wherein said diamond grains have a mean grain size in a range from 10 to 1000 μm.

17. The superhard composite member in accordance with claim 1, wherein a content of said diamond grains is 5 to 50 vol. % of said composite member.

18. The superhard composite member in accordance with claim 1, wherein a content of said binder phase is 10 to 50 vol. % of said composite member.

19. The superhard composite member in accordance with claim 1, wherein a content proportion of said diamond grains varies in a thickness direction so as to be greater toward a first surface of said superhard composite member and lesser toward a second surface of said superhard composite member opposite said first surface.

20. The superhard composite member in accordance with claim 1, further in combination with and connected onto a substrate containing at least any one of WC cemented carbide, TiC(N) cermet and a metal material.

21. The superhard composite member in accordance with claim 1, further comprising at least any one of cubic boron nitride and wurtzite boron nitride also dispersed in said structure including said hard phase and said binder phase.

22. The superhard composite member in accordance with claim 1, wherein said plurality of diamond grains have at least either a structure including no diamond skeletons or a structure including no parts where said diamond grains are directly bonded to each other.

23. The superhard composite member in accordance with claim 22, being configured and adapted as a cutter bit for a shield machine.

24. A superhard composite member comprising a hard phase being mainly composed of WC, a binder phase being mainly composed of Co, and a plurality of diamond grains being dispersed in a structure including said hard phase and said binder phase, the main crystal system of said Co being f.c.c., superhard composite member containing at least 5 vol. % and not more than 50 vol. % of said diamond grains with no parts where said diamond grains are directly bonded to each other, and said superhard composite member having apparent porosity satisfying the range of A00 to A08 and B00 to B08 according to ISO standards.

25. A method of manufacturing the superhard composite member of claim 1, said method comprising the steps of:

mixing raw powder materials including a diamond powder containing said diamond grains, a hard phase powder containing said material of said hard phase, and a binder phase powder containing said iron family metal, with each other for obtaining a mixed raw material; and sintering said mixed raw material by directly resistance heating said mixed raw material to a prescribed temperature and applying a prescribed pressure to said mixed raw material.

26. The method of manufacturing a superhard composite member in accordance with claim 25, wherein said prescribed temperature is at least 1100° C. and not more than 1350° C., and said prescribed pressure is at least 5 MPa and not more than 200 MPa.

27. The method of manufacturing a superhard composite member in accordance with claim 25, wherein said step of obtaining said mixed raw material further includes a step of coating at least any one of said diamond powder and said hard phase powder with at least either Co or Ni.

28. The method of manufacturing a superhard composite member in accordance with claim 25, wherein said step of obtaining said mixed raw material further includes a step of coating said diamond powder with at least one metal being selected from a group consisting of Ir, Os, Pt, Re, Rh, Cr, Mo and W.

29. The method of manufacturing a superhard composite member in accordance with claim 25, wherein said raw powder materials further include at least one metal being selected from elements belonging to the groups IVa, Va and VIa of the periodic table and Si.

30. The method of manufacturing a superhard composite member in accordance with claim 25, wherein said step of mixing said raw powder materials comprises using mechanical alloying.

31. The method of manufacturing a superhard composite member in accordance with claim 25, wherein said sintering is carried out for a time not greater than 10 minutes.

32. The method of manufacturing a superhard composite member in accordance with claim 25, wherein said sintering is performed while allowing appearance of a liquid phase.

33. The method of manufacturing a superhard composite member in accordance with claim 25, wherein said step of obtaining said mixed raw material further includes a step of obtaining a plurality of types of mixed raw materials respectively having different mixing ratios of said diamond powder, wherein said plurality of types of mixed raw materials are arranged in order of said mixing ratios of said diamond powder and sintered in said sintering step, thereby varying a proportional content of said diamond grains in a thickness direction of said composite member.

34. The method of manufacturing a superhard composite member in accordance with claim 25, wherein said sintering step further includes a step of arranging said mixed raw material on a substrate to provide a composite body, heating said composite body of said mixed raw material and said substrate by resistance heating, and sintering said mixed raw material thereby obtaining a sintered body while sintering and bonding said sintered body onto said substrate.

35. The method of manufacturing a superhard composite member in accordance with claim 34, wherein said step of obtaining said mixed raw material further includes a step of obtaining a plurality of types of mixed raw materials respectively having different mixing ratios of said diamond powder, wherein said plurality of types of mixed raw materials are arranged on said substrate in order of said mixing ratios of said diamond powder and sintered in said sintering step, thereby varying a proportional content of said diamond grains in a thickness direction of said composite member.

36. The method of manufacturing a superhard composite member in accordance with claim 25, wherein said raw powder materials further include at least any one of cubic boron nitride and wurtzite boron nitride that is mixed together with said diamond powder, said hard phase powder and said binder phase powder.

* * * * *

UNITED STATES PATENT AND TRADEMARK OFFICE
CERTIFICATE OF CORRECTION

PATENT NO. : 5,889,219

DATED : Mar. 30, 1999

INVENTOR(S) : Moriguchi et al.

It is certified that error appears in the above-identified patent and that said Letters Patent is hereby corrected as shown below:

On the Title Page, under "Foreign Application Priority Data", line 1,
replace "Nov. 16, 1995" by --Nov. 15, 1995--.

Col. 1, line 8, after "grains", delete ",";
line 9, after "composite", insert --,--.

Col. 3, line 36, after "vertical", insert --,--;
line 37, after "perpendicular" insert --,--.

Col. 7, line 47, before "duration", delete "term".

Col. 12, line 51, before "deposits", replace "there" by --these--.

Col. 24, line 21, before "superhard", insert --said--.

Signed and Sealed this

Fourteenth Day of December, 1999

*Attest:*

Q. TODD DICKINSON

*Attesting Officer*

*Acting Commissioner of Patents and Trademarks*